US011578718B2

(12) United States Patent
Jang et al.

(10) Patent No.: US 11,578,718 B2
(45) Date of Patent: Feb. 14, 2023

(54) APPARATUS FOR REDUCING NOISE OF GEAR PUMP THROUGH UNEVEN PITCH-SIMULATED CONTROL AND METHOD THEREOF

(71) Applicants: Hyundai Motor Company, Seoul (KR); Kia Corporation, Seoul (KR); Myunghwa Ind. Co., Ltd., Seoul (KR)

(72) Inventors: Sung Wook Jang, Suwon-si (KR); Dong Kuk Han, Seoul (KR); MinSu Kim, Seoul (KR); Chin Chul Choi, Suwon-si (KR); Byung Jun Hwang, Seoul (KR); Hyung Suk Kim, Suwon-si (KR)

(73) Assignees: Hyundai Motor Company, Seoul (KR); Kia Corporation, Seoul (KR); Myunghwa Ind. Co., Ltd., Seoul (KR)

( * ) Notice: Subject to any disclaimer, the term of this patent is extended or adjusted under 35 U.S.C. 154(b) by 0 days.

(21) Appl. No.: 17/340,966

(22) Filed: Jun. 7, 2021

(65) Prior Publication Data

US 2022/0049696 A1 Feb. 17, 2022

(30) Foreign Application Priority Data

Aug. 11, 2020 (KR) ..... 10-2020-0100525

(51) Int. Cl.
*F03C 2/00* (2006.01)
*F03C 4/00* (2006.01)
(Continued)

(52) U.S. Cl.
CPC ..... *F04C 2/084* (2013.01); *F04C 14/08* (2013.01); *F04C 2270/075* (2013.01); *F04C 2270/135* (2013.01)

(58) Field of Classification Search
CPC .. F04C 2/084; F04C 2/086; F04C 2/14; F04C 2/18; F04C 14/08; F04C 28/08;
(Continued)

(56) References Cited

U.S. PATENT DOCUMENTS

2010/0054949 A1 3/2010 Jang et al.
2010/0322805 A1* 12/2010 Aregger ..... F04C 2/18 418/206.5
(Continued)

FOREIGN PATENT DOCUMENTS

DE 102011121837 A1 * 6/2013 ..... F04B 49/06
DE 102013216342 A1 * 2/2015 ..... F04C 14/08
(Continued)

*Primary Examiner* — Theresa Trieu
(74) *Attorney, Agent, or Firm* — Slater Matsil, LLP

(57) ABSTRACT

An apparatus for reducing noise of a gear pump through uneven pitch-simulated control includes a calculation unit to calculate different control current values for each tooth of a teeth order by applying a teeth number, the teeth order, and a teeth angle of the gear pump in which a plurality of teeth are evenly formed, a storage unit to map and store the teeth order and the different control current values corresponding to the teeth order for each tooth, and a current controller to variably generate the control current value mapped corresponding to the teeth order when each tooth reaches a reference position when the gear pump rotates by a motor, wherein the control current value is added to a reference current value of a motor control signal and applied to the motor.

18 Claims, 7 Drawing Sheets

(51) Int. Cl.

| | |
|---|---|
| ***F04C 18/00*** | (2006.01) |
| ***F04C 2/00*** | (2006.01) |
| ***F04C 2/08*** | (2006.01) |
| ***F04C 14/08*** | (2006.01) |

(58) Field of Classification Search
CPC ..... F04C 29/06; F04C 2240/403; F04C 2270/05; F04C 2270/051; F04C 2270/075; F04C 2270/135
See application file for complete search history.

(56) References Cited

U.S. PATENT DOCUMENTS

| | | | | |
|---|---|---|---|---|
| 2018/0291895 | A1* | 10/2018 | Afshari ..... | F04C 14/08 |
| 2019/0190430 | A1 | 6/2019 | Jung | |

FOREIGN PATENT DOCUMENTS

| | | | |
|---|---|---|---|
| JP | H01247790 | A | 10/1989 |
| JP | 2000041400 | A | 2/2000 |
| JP | 2013249820 | A | 12/2013 |
| KR | 100872294 | B1 | 12/2008 |
| KR | 20190073739 | A | 6/2019 |

* cited by examiner $y = e^{-B_m x^2}$
where $-1 \leq x \leq 1$

APPARATUS FOR REDUCING NOISE OF GEAR PUMP THROUGH UNEVEN PITCH-SIMULATED CONTROL AND METHOD THEREOF

CROSS-REFERENCE TO RELATED APPLICATIONS

This application claims the benefit of Korean Patent Application No. 10-2020-0100525, filed on Aug. 11, 2020, which application is hereby incorporated herein by reference.

TECHNICAL FIELD

This present invention relates to an apparatus for reducing noise of a gear pump through uneven pitch-simulated control.

BACKGROUND

Generally, if a plurality of blades installed in an exterior circumference of an impeller is evenly disposed, there is a problem that noise is generated in a frequency band corresponding to the number of the blades when the impeller is operated.

To solve the above problem, conventionally, a method in which the blades are disposed at an uneven pitch arrangement is used, thereby reducing sound pressure and minimizing a pulsation sound (e.g., a low frequency peak) generated by the blades being unevenly disposed has been proposed.

However, in the case of an electric hydraulic pump, since two gears are engaged, the teeth of the gear must be disposed evenly. Therefore, it is not possible to apply the uneven pitch gears to the electric hydraulic pump. Further, there is a problem that noise is generated in a frequency band corresponding to the number of teeth when the electric hydraulic pump is operated.

The above information disclosed in this Background section is only for enhancement of understanding of the background of the invention, and therefore it may contain information that does not form the prior art that is already known to a person of ordinary skill in the art.

Conventional technology is disclosed in Korea Patent Laid-open 10-0872294 (Dec. 5, 2008) and U.S. counterpart Pub. No. 2010/0054949.

SUMMARY

This present invention relates to an apparatus for reducing noise of a gear pump through uneven pitch-simulated control. Particular embodiments relate to an apparatus for reducing noise of a gear pump that can reduce a driving noise of a gear pump through uneven pitch-simulated control.

An embodiment of the present invention provides an apparatus for reducing noise of a gear pump through uneven pitch-simulated control in which uneven pitch gears are simulated through controlling a current value of a drive motor when a gear pump is operated such that a driving noise is effectively reduced.

In an apparatus for reducing noise of a gear pump through uneven pitch-simulated control, the apparatus may include a calculation unit calculating different control current values for each tooth of a teeth order by applying a teeth number, the teeth order, and a teeth angle of a gear pump in which a plurality of teeth are evenly formed to a predetermined function, a storage unit mapping and storing the teeth order and the different control current values corresponding to the teeth order for each tooth, and a current controller variably generating the control current value mapped corresponding to the teeth order whenever each tooth reaches a reference position when the gear pump rotates by a motor, wherein the control current value is added to a reference current value of a motor control signal and applied to the motor.

The current controller may instantaneously generate the control current value mapped with a tooth corresponding to the teeth order at a time when the tooth corresponding to the teeth order reaches the reference position, and apply only the reference current value to the motor during the remaining time when the control current value is not generated.

The current controller may variably generate the control current value corresponding to all teeth sequentially reaching the reference position according to time, and a pattern of the control current according to time may have a sine function form.

An n-th control current value corresponding to an n-th teeth order is calculated from an equation of $$i_{uneven}^{ref} = I_{\Delta\theta n} \times e^{-B_m\{mod(\theta,\frac{2\pi}{N})-1\}^2},$$

and N may denote the tooth number, n may denote the teeth order (n=1, 2, . . . , N), 2π/N may denote the tooth angle, $I_{\Delta\theta n}$ may denote a basic current value applied to the n-th tooth, e(•) may denote an exponential function for adjusting $I_{\Delta\theta n}$, and Bm may denote a variable determined from a type of the gear pump and have a value between 10 and 90.

The $I_{\Delta\theta n}$ is calculated from an uneven pitch generating function of $$I_{\Delta\theta n} = (-1)^n \cdot A_m\left\{\sin\left(P_1\frac{360}{N}n\right) \times \cos\left(P_2\frac{360}{N}n\right)\right\},$$

and $A_m$ may denote a current reference value and have a range of 5A±20%, $0<P_1<N$, and $0<P_2<N$.

In a method for reducing noise of a gear pump through uneven pitch-simulated control, the method may include calculating different control current values for each tooth of a teeth order by applying the teeth number, the teeth order, and the teeth angle of the gear pump to the predetermined function, mapping and storing the teeth order and the control current value corresponding to the teeth order for each tooth, and variably generating the control current value mapped with the teeth order whenever the tooth sequentially reaches a reference position, wherein the control current value is added to a reference current value of a motor control signal and applied to the motor.

In the variably generating the control current value, the control current value mapped with the tooth corresponding to the teeth order may be instantaneously generated at a time when the tooth corresponding to the teeth order reaches the reference position, and only the reference current value may be applied to the motor during the remaining time when the control current value is not generated.

In the variably generating the control current value, the control current value may be variably generated corresponding to all teeth sequentially reaching the reference position according to time, and a pattern of the control current according to time may have a sine function form.

According to an embodiment of the present invention, the effect of uneven pitch for noise reduction can be implemented in software by controlling the current value of the motor operating the gear pump according to time without applying structural changes to the gear pump.

According to an embodiment, an apparatus comprises a gear pump that includes a gear with a plurality of teeth that are evenly formed. A motor is coupled to drive the gear pump. A processor is configured to calculate different control current values for a function. The control current values are calculated for each tooth by applying a teeth number, a teeth order, and a teeth angle. A memory is configured to map and store a control current value of the teeth order and the different control current values corresponding to the teeth order for each tooth. A current generator is configured to variably generate the control current value mapped by the different control current values corresponding to the teeth order when each tooth reaches a reference position when the gear pump rotates by the motor. A current adder has inputs coupled to receive the generated control current value and a reference current value and an output coupled to the motor.

Figure 1:
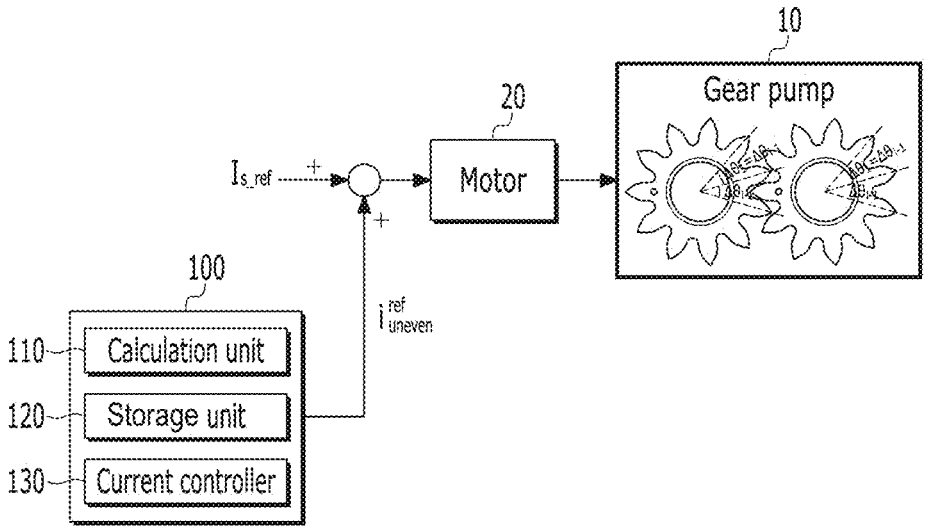
FIG. 1 is a drawing illustrating an apparatus for reducing noise of a gear pump through an uneven pitch-simulated control according to an embodiment of the present invention.

The following elements may be used in connection with the drawings to describe embodiments of the present invention.

10: gear pump
20: motor
100: apparatus for reducing noise of gear pump
110: calculation unit
120: storage unit
130: current controller

DETAILED DESCRIPTION OF ILLUSTRATIVE EMBODIMENTS

The present invention will be described more fully hereinafter with reference to the accompanying drawings, in which embodiments of the invention are shown. As those skilled in the art would realize, the described embodiments may be modified in various different ways, all without departing from the spirit or scope of the present invention. Accordingly, the drawings and description are to be regarded as illustrative in nature and not restrictive. Like reference numerals designate like elements throughout the specification.

Throughout this specification and the claims that follow, when it is described that an element is "coupled" to another element, the element may be "directly coupled" to the other element or "electrically coupled" to the other element through a third element. Throughout this specification and the claims which follow, unless explicitly described to the contrary, the word "comprising" or variations such as "comprises" will be understood to imply the inclusion of stated elements but not the exclusion of any other elements.

FIG. 1 is a drawing illustrating an apparatus for reducing noise of a gear pump through uneven pitch-simulated control according to an embodiment of the present invention.

As shown in FIG. 1, an apparatus 100 for reducing noise of a gear pump through uneven pitch-simulated control according to an embodiment of the present invention may include a calculation unit 110, a storage unit 120, and a current controller 130.

The apparatus 100 applies a control current for simulating an effect of an uneven pitch to a motor 20 driving a gear pump 10 (e.g., an electric hydraulic pump) so that noise generated when the gear pump 10 is operated is minimized.

In the case of a conventional impeller, driving noise is minimized by applying the uneven pitch that makes the spacing between blades different. However, in the case of the gear pump 10, it is impossible to apply a structure of the uneven pitch because two gears are externally engaged with each other and the spacing between the teeth must be constant.

In an embodiment of the present invention, the effect of uneven pitch for noise reduction can be implemented in software by controlling the current value of the motor 20 operating the gear pump 10 according to time without applying structural changes to the gear pump 10.

Herein, the apparatus for reducing noise of the gear pump according to an embodiment of the present invention will be described in detail referring to FIG. 1.

The calculation unit 110 calculates different control values for each tooth by applying a teeth number (N), a teeth order (n=1, 2, . . . , N), and a teeth angle (2π/N) of the gear pump 10 in which a plurality of teeth are evenly formed to a predetermined function.

In the case of FIG. 1, it is an example that the teeth number (N) is 11. In this case, the teeth angle (2π/N) is 32.7 degrees (360/11), and the teeth order exists from 1 to 11.

The predetermined function may be defined as in the following Equation 1.

$$i_{uneven}^{ref} = I_{\Delta\theta n} \times e^{-B_m\{mod(\theta,\frac{2\pi}{N})-1\}^2} \qquad \text{Equation 1}$$

Equation 1 represents a function for calculating an n-th control current corresponding to a tooth of an n-th tooth order, the N denotes the tooth number, the n denotes the tooth order, and the 2π/N denotes the tooth angle.

$I_{\Delta\theta n}$ is a basic current value applied to the n-th tooth, and is calculated based on an uneven pitch generating function. e(•) denotes an exponential function for adjusting $I_{\Delta\theta n}$.

The $B_m$ is a variable determined from a type of the gear pump, and has a value between 10 and 90. The $B_m$ may vary according to the type of the gear pump 10.

The mod(A,B) is a known function that calculates the remainder of A divided by B.

Figure 2:
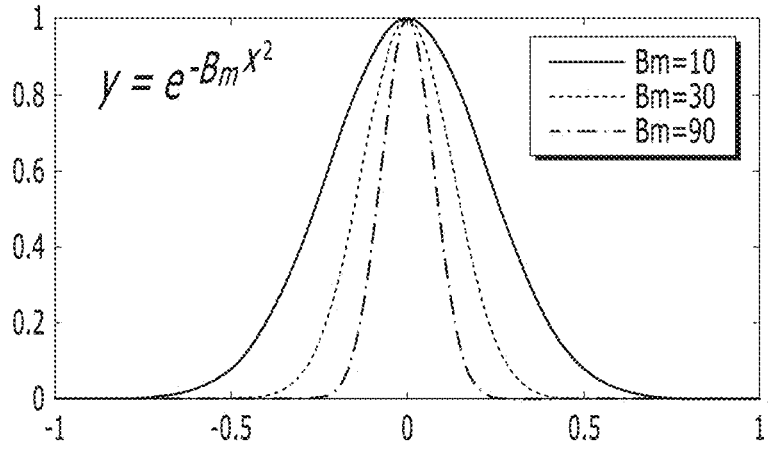
FIG. 2 is a graph illustrating a predetermined function according to a variation of a variable Bm.

FIG. 2 is a graph illustrating a predetermined function according to a variation of a variable $B_m$.

Referring to FIG. 2, Equation 1 may be simply expressed as $y=e^{-B_m x^2}$. At this time, x is set to a range of $-1 \leq x \leq 1$ in consideration of the mod function.

Referring to FIG. 2, it can be seen that the pattern of the predetermined function changed according to an adjustment of $B_m$ (e.g., $B_m$=10, 30, 90). As the $B_m$ value is increased from 10 to 90, the bell-shaped pattern becomes narrower. As such, the pattern of the predetermined function can be adjusted as the $B_m$ value is applied differently based on the type of the gear pump.

$I_{\Delta\Theta n}$ of Equation 1 may be calculated based on the uneven pitch generating function of the following Equation 2.

$$I_{\Delta\theta n} = (-1)^n \cdot A_m\left\{\sin\left(P_1 \frac{360}{N} n\right) \times \cos\left(P_2 \frac{360}{N} n\right)\right\} \quad \text{Equation 2}$$

In Equation 2, the $A_m$ denotes a current reference value and has a range of 5A±20%, the $P_1$ and the $P_2$ are factors that affect the period, the $P_1$ is $0<P_1<N$, and the $P_2$ is $0<P_2<N$.

Since the tooth order (n) exist from 1 to 10, $I_{\Delta\Theta n}$ of Equation 2 is calculated for each tooth, and $i_{uneven}^{ref}$ of Equation 1 is calculated using $I_{\Delta\Theta n}$. That is, a total of 11 Equations 1 are derived corresponding to the teeth number.

The storage unit 120 receives a calculating result from the calculation unit, and stores the calculating result. At this time, the storage unit 120 maps and stores the control current value derived for each tooth with the teeth order. The current controller 130 changes the control current value based on the position of each tooth and information stored in the storage unit 120 when the motor 20 is driven.

In detail, the current controller 130 variably generates the mapped control current value corresponding to the tooth of the teeth order whenever each tooth reaches the reference position when the gear pump 10 rotates by the motor 20.

Each tooth reaches the reference position whenever the gear pump 10 rotates 32.7 degrees. Here, the reference position may correspond to a dotted line (-•-) point, for example. The position of each tooth may be easily checked through a rotation angle of an axis of the motor 20.

Referring to FIG. 1, the control current value generated by the current controller 130 is added to a reference current value (Is_ref) which is a motor control signal and is applied to the motor 20.

The gear pump 10 is engaged with the axis of the motor 20 and rotated by the motor 20, and the tooth of the gear pump 10 sequentially reaches the predetermined reference position as the gear pump 10 rotates.

The current controller 130 generates the control current value corresponding to the tooth of the teeth order by referring to the information mapped in the storage unit 120 whenever the first to eleventh tooth sequentially reaches the reference position. As such, the current controller 130 generates the control current value corresponding to the tooth of the teeth order at an appropriate time.

Herein, timing when the tooth corresponding to the teeth order reaches the reference position may be easily determined from an angle of a rotation axis of the motor. For example, each time the rotation axis of the motor rotates by 32.7 degrees, the teeth order reaching the reference position is sequentially changed.

In an embodiment of the present invention, the current controller 130 instantaneously generates the control current value mapped with the tooth corresponding to the teeth order at a time when the tooth corresponding to the teeth order reaches the reference position. Accordingly, only the reference current value is applied to the motor 20 during the remaining time when the control current value is not generated.

Figure 3:
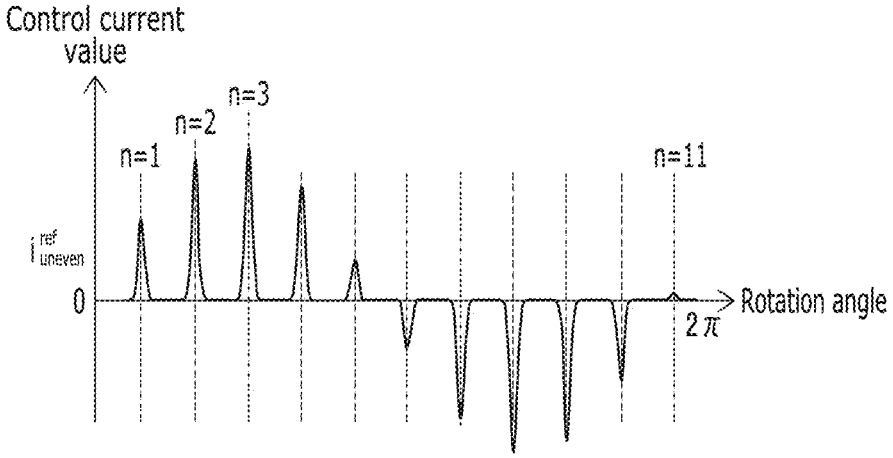
FIG. 3 is a graph illustrating control current generated corresponding to each teeth order according to an embodiment of the present invention.

FIG. 3 is a graph illustrating a control current generated corresponding to each teeth order according to an embodiment of the present invention.

In FIG. 3, the horizontal axis denotes an angle of the gear pump and represents a range of 0-360 degrees, and the vertical axis denotes the control current value generated for each tooth of the teeth order. Since the angle of the gear pump varies with time, the vertical axis of FIG. 3 may correspond to a time axis.

The current controller 130 variably generates the control current value corresponding to all teeth sequentially reaching the reference position according to time. At this time, the current controller 130 instantaneously generates the control current value by Equation 1 whenever the tooth reaches the reference position.

Herein, it can be seen that the pattern of the control current according to time has a sine function form. That is, the control current value may have a sine function form with a period of 360 degrees.

Further, since the control current value is added to the reference current value ($I_{s_ref}$) and is applied to the motor 20 as an input current (see FIG. 1), only the reference current ($I_{s_ref}$) is applied to the motor 20 while the control current is not generated (the time when the control current is zero).

Figure 4:
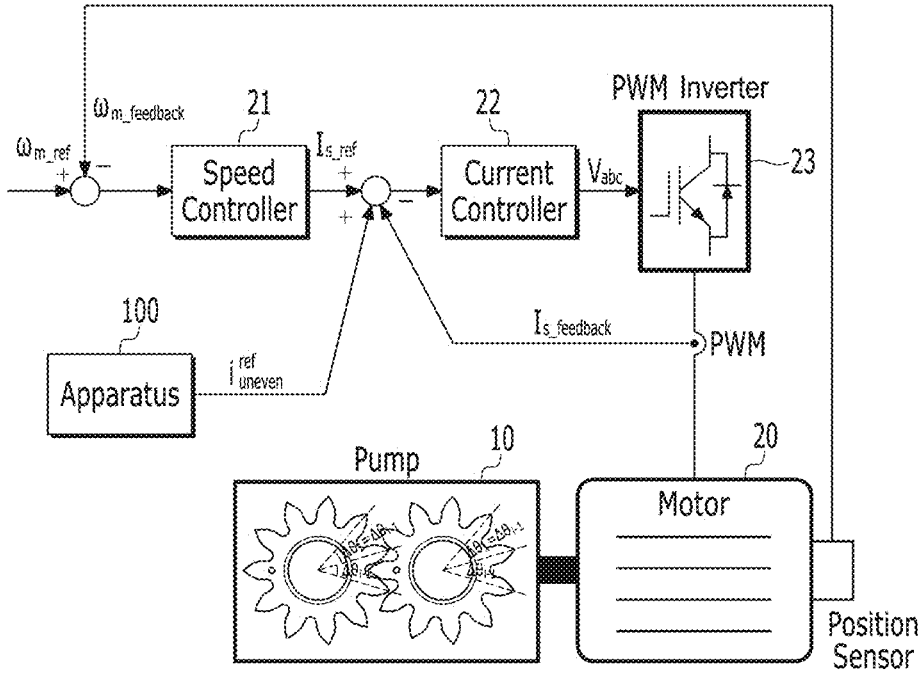
FIG. 4 is a drawing illustrating a pump control system applied to an apparatus for reducing noise of a gear pump through uneven pitch-simulated control according to an embodiment of the present invention.

FIG. 4 is a drawing illustrating a pump control system applied with an apparatus for reducing noise of a gear pump through uneven pitch-simulated control according to an embodiment of the present invention.

FIG. 4 shows a motor driving unit for operating the motor 20. Referring to FIG. 4, the motor driving unit may include a speed controller 21, a current controller 22, and a PWM inverter 23. The motor driving unit may be embedded in the motor 20, or connected to the motor 20.

The motor driving unit controls the motor 20 through PWM control based on a PWM (pulse width modulation) signal generated corresponding to the control value, and the motor 20 is driven and speed-controlled by the PWM control.

The motor driving unit is electrically connected between the apparatus 100 and the motor 20, adds the control current value generated by the apparatus 100 and the reference current value output from the speed controller 21, and applies them (control current value and reference current value) to the current controller 22. Only the reference current value is applied to the current controller 22 while the control current is zero.

The current controller 22 converts the current value to a voltage value and outputs the voltage value to the PWM inverter 23. The PWM inverter 23 generates the PWM signal based on the voltage value input from the current controller 22 and applies the PWM signal to the motor 20. The operation and speed of the axis of the motor 20 are controlled according to the PWM signal, and accordingly, the operation and speed of the gear pump 10 connected to the axis of the motor 20 are controlled.

The motor may be provided with a position sensor to detect a rotation position or a rotation angle of the axis of the motor 20. The rotation position or the rotation angle of the axis detected by the position sensor is transmitted to the speed controller 21, and the speed controller 21 may compensate an error between a feedback angle (ωm_feedback) (e.g., the rotation angle of the axis of the motor detected by the position sensor) and the reference angle (ωm_ref). In addition, the PWM signal output from the PWM inverter 23 may be fed back to the reference current value.

As described above, it can be seen that the control current value generated by the apparatus 100 is used as an input signal to control the motor 20. The apparatus 100 may be electrically connected to the motor 20 like in FIG. 4, but the apparatus 100 may be embedded in the motor driving unit.

Since the motor driving unit generates the control current value for controlling the speed of the motor 20 by reflecting the rotation angle of the axis of the motor 20, it is possible to stably control the motor 20.

Figure 5:
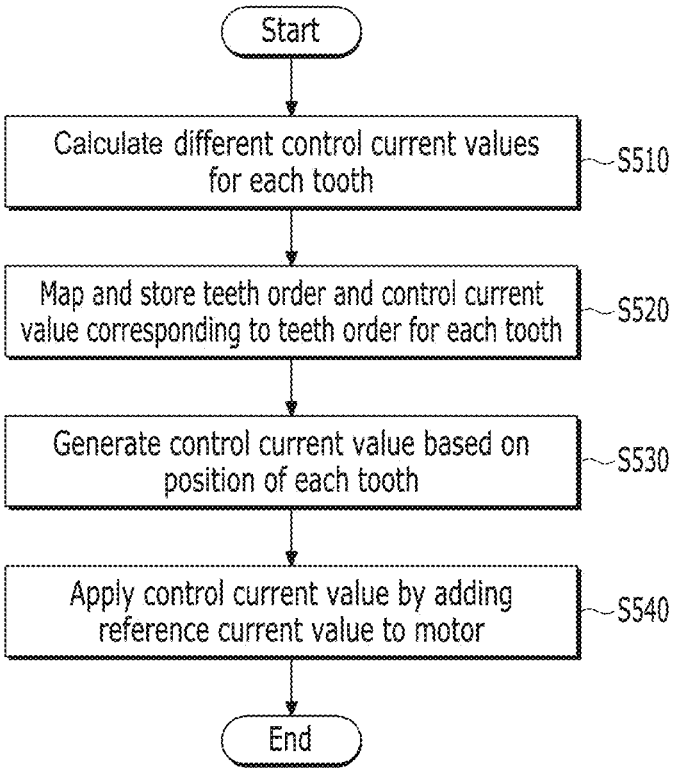
FIG. 5 is a flowchart illustrating a method for reducing noise of a gear pump through uneven pitch-simulated control according to an embodiment of the present invention.

FIG. 5 is a flowchart illustrating a method for reducing noise of a gear pump through uneven pitch-simulated control according to an embodiment of the present invention.

As shown in FIG. 5, the apparatus 100 for reducing noise of the gear pump calculates different control current values for each tooth of the teeth order by applying the teeth number, the teeth order, and the teeth angle of the gear pump 10 to the predetermined function at step S510. At this time, the apparatus 100 may calculate the control current value corresponding to the tooth of the teeth order through Equation 1 based on the uneven pitch generating function.

The apparatus 100 maps and stores the teeth order and the control current value corresponding to the teeth order for each tooth at step S520. Then, the apparatus 100 operates the gear pump 10 based on the mapped information, thereby minimizing the operation noise of the gear pump 10.

For this, the apparatus 100 generates the control current value based on the position of each tooth while the gear pump 10 is operated by the motor 20. In detail, the apparatus 100 generates the control current value mapped with the teeth order by synchronizing the timing when each tooth of the gear pump 10 sequentially reaches the reference position at step S530.

The control current value is added to the reference current value, and is applied to the motor 20 as a control signal at step S540.

In an embodiment of the present invention, the gear pump 10 may be an electric hydraulic pump. When the method according to an embodiment of the present invention is applied to the electric hydraulic pump, the motor speed and torque are instantaneously changed to enable simulation control similar to that applied with an uneven pitch.

That is, by varying the current (or torque) applied to each position of the tooth of an external gear to which the uneven pitch cannot be mechanically applied, it is possible to implement control that simulates the uneven pitch.

Figure 6:
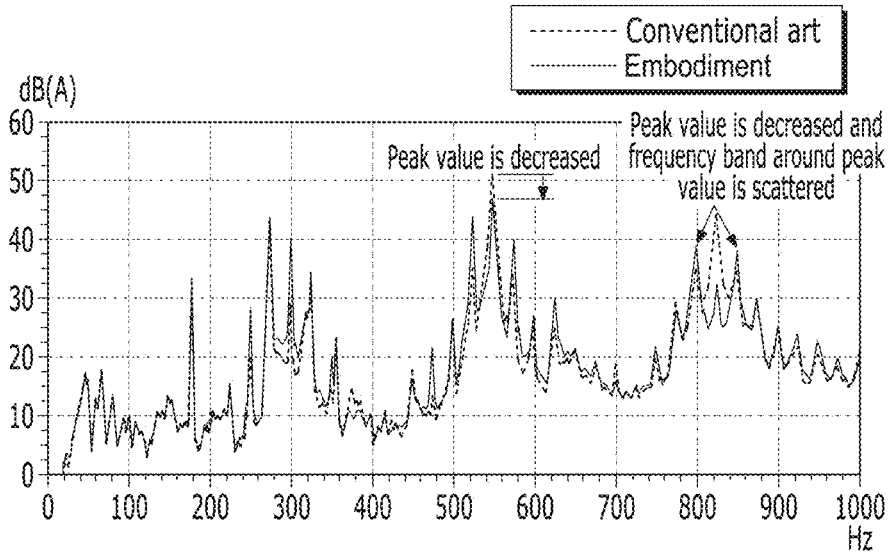
FIG. 6 is a graph illustrating a noise measurement result when uneven pitch-simulated control according to the embodiment of the present invention is applied to an electric hydraulic pump and a noise measurement result of the conventional art when the uneven pitch-simulated control is not applied to an electric hydraulic pump.

FIG. 6 is a graph illustrating a noise measurement result when uneven pitch-simulated control according to an embodiment of the present invention is applied to an electric hydraulic pump and a noise measurement result of the conventional art when the uneven pitch-simulated control is not applied to an electric hydraulic pump.

At this time, as a test condition for reducing noise, the teeth number of an external gear is set to 11, the rotation speed of the gear is set to 1500 RPM, and the hydraulic pressure in the gear pump is set to 1 bar.

Referring to FIG. 6, the entire noise value of the present invention is almost the same as the conventional art, but it can be seen that the peak value of the noise value is decreased and a frequency band around the peak value is scattered at multiple frequencies (e.g., 550 Hz, 825 Hz) of a mixed frequency (e.g., 275 Hz=25 Hz×11) of rotation speed and teeth number. Particularly, the maximum peak value of embodiments of the present invention is decreased by about 4-5 dB comparing to the conventional art.

Figure 7:
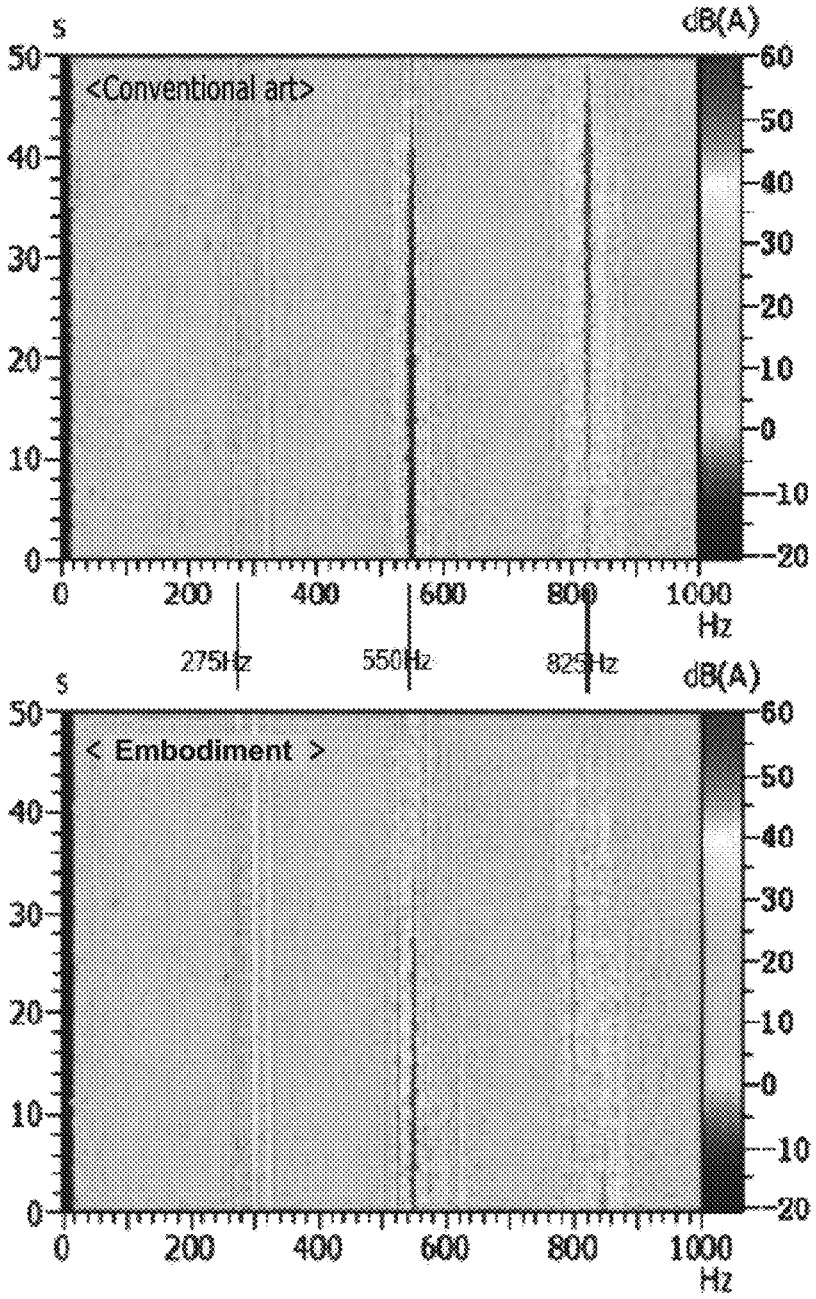
FIG. 7 is a spectrogram when an uneven pitch-simulated control according to the embodiment of the present invention is applied to an electric hydraulic pump and a spectrogram of the conventional art when the uneven pitch-simulated control is not applied to an electric hydraulic pump.

FIG. 7 is a spectrogram when an uneven pitch-simulated control according to an embodiment of the present invention is applied to an electric hydraulic pump and a spectrogram of the conventional art when the uneven pitch-simulated control is not applied to an electric hydraulic pump. FIG. 7 is a spectrogram showing noise levels in color in a frequency-time domain. In FIG. 7, the closer to the dark color, the greater the noise.

Referring to FIG. 7, it can be seen that the noise of embodiments of the present invention is reduced in 550 Hz and 825 Hz frequency bands, and the noise band is dispersed compared to the conventional art. If embodiments of the present invention are applied to a specific rotation speed for avoiding resonance frequency, a noise reduction effect can be maximized.

According to an embodiment of the present invention as described above, when the gear pump in which the teeth are evenly disposed is operated, since the uneven pitch-simulated control is performed by software based on the current value applied to the motor, it is possible to effectively reduce driving noise of the gear pump.

While this invention has been described in connection with what is presently considered to be practical embodiments, it is to be understood that the invention is not limited to the disclosed embodiments, but, on the contrary, is intended to cover various modifications and equivalent arrangements included within the spirit and scope of the appended claims.

What is claimed is:

1. An apparatus for reducing noise of a gear pump through uneven pitch-simulated control, the apparatus comprising:

a calculation unit configured to calculate different control current values for each tooth of a teeth order by applying a teeth number, the teeth order, and a teeth angle of the gear pump in which a plurality of teeth are evenly formed to a predetermined function corresponding to a variable value between 10 and 90 applied differently based on a type of the gear pump;

a storage unit configured to map and store a control current value of the teeth order and the different control current values corresponding to the teeth order for each tooth; and a current controller configured to variably generate the control current value mapped by the different control current values corresponding to the teeth order when each tooth reaches a reference position when the gear pump rotates by a motor, wherein the control current value is added to a reference current value of a motor control signal and applied to the motor.

2. The apparatus of claim 1, wherein the current controller is configured to:

instantaneously generate the control current value mapped with the tooth corresponding to the teeth order at a time when the tooth corresponding to the teeth order reaches the reference position; and apply only the reference current value to the motor during a remaining time when the control current value is not generated.

3. The apparatus of claim 1, wherein the current controller is configured to variably generate the control current value corresponding to all teeth sequentially reaching the reference position according to time.

4. The apparatus of claim 3, wherein a pattern of the control current, value according to time has a sine function form.

5. The apparatus of claim 1, wherein an n-th control current value corresponding to an n-th teeth order is calculated from an equation $$i_{uneven}^{ref} = I_{\Delta\theta n} \times e^{-B_m\{mod(\theta,\frac{2\pi}{N})-1\}^2},$$

in which N denotes the tooth number, n denotes the teeth order (n=1, 2, . . . , N), 2π/N denotes the tooth angle, $I_{\Delta\theta n}$ denotes a basic current value applied to the n-th tooth, e(•) denotes an exponential function for adjusting$I_{\Delta\theta n}$, and $B_m$ is the variable value.

6. The apparatus of claim 5, wherein the $I_{\Delta\theta n}$ is calculated from an uneven pitch generating function $$I_{\Delta\theta n} = (-1)^n \cdot A_m\left\{\sin\left(P_1\frac{360}{N}n\right)\times\cos\left(P_2\frac{360}{N}n\right)\right\},$$

in which Am denotes a current reference value and has a range of 5A±20%, P1 and P2 are factors that affect a period of the basic current value, o<P1<N, and o<P2<N.

7. A method for reducing noise of a gear pump through an uneven pitch-simulated control, the method comprising:

calculating different control current values for each tooth of a teeth order by applying a teeth number, the teeth order, and a teeth angle of the gear pump in which a plurality of teeth are evenly formed to a function corresponding to a variable value between 10 and 90 applied differently based on a type of the gear pump;

mapping and storing a control current value of the teeth order and the different control current values corresponding to the teeth order for each tooth; and variably generating the control current value mapped with the teeth order when the tooth sequentially reaches a reference position, wherein the control current value is added to a reference current value of a motor control signal and applied to a motor.

8. The method of claim 7, wherein:

the control current value mapped with the tooth corresponding to the teeth order is instantaneously generated at a time when the tooth corresponding to the teeth order reaches the reference position; and only the reference current value is applied to the motor during a remaining time when the control current value is not generated.

9. The method of claim 7, wherein the control current value is variably generated corresponding to all teeth sequentially reaching the reference position according to time.

10. The method of claim 9, wherein a pattern of the control current value according to time has a sine function form.

11. The method of claim 7, wherein an n-th control current value corresponding to an n-th teeth order is calculated from an equation $$i_{uneven}^{ref} = I_{\Delta\theta n} \times e^{-B_m\{mod(\theta,\frac{2\pi}{N})-1\}^2},$$

in which N denotes the tooth number, n denotes the teeth order (n=1, 2, N), 2π/N denotes the tooth angle, $I_{\Delta\theta n}$ denotes a basic current value applied to the n-th tooth, e(•) denotes an exponential function for adjusting $I_{\Delta\theta n}$, and Bm is the variable value.

12. The method of claim 11, wherein the $I_{\Delta\theta n}$ is calculated from an uneven pitch generating function $$I_{\Delta\theta n} = (-1)^n \cdot A_m\left\{\sin\left(P_1\frac{360}{N}n\right)\times\cos\left(P_2\frac{360}{N}n\right)\right\},$$

in which Am denotes a current reference value and has a range of 5A±20%, P1 and P2 are factors that affect a period of the basic current value, o<P1<N, and o<P2<N.

13. An apparatus comprising:

a gear pump that includes a gear with a plurality of teeth that are evenly formed;

a motor coupled to drive the gear pump;

a processor configured to calculate different control current values for a function corresponding to a variable value between 10 and 90 applied differently based on a type of the gear pump, the different control current values being calculated for each tooth by applying a teeth number, a teeth order, and a teeth angle;

a memory configured to map and store a control current value of the teeth order and the different control current values corresponding to the teeth order for each tooth;

a current generator configured to variably generate the control current value mapped by the different control current values corresponding to the teeth order when each tooth reaches a reference position when the gear pump rotates by the motor; and a current adder having inputs coupled to receive the generated control current value and a reference current value and an output coupled to the motor.

14. The apparatus of claim 13, wherein the current generator is configured to:

instantaneously generate the control current value mapped with the tooth corresponding to the teeth order at a time when the tooth corresponding to the teeth order reaches the reference position; and apply only the reference current value to the motor during a remaining time when the control current value is not generated.

15. The apparatus of claim 13, wherein the current generator is configured to variably generate the control current value corresponding to all teeth sequentially reaching the reference position according to time.

16. The apparatus of claim 15, wherein a pattern of the control current value according to time has a sine function form.

17. The apparatus of claim 13, wherein an n-th control current value corresponding to an n-th teeth order is calculated from an equation $$i_{uneven}^{ref} = I_{\Delta\theta n} \times e^{-B_m\{mod(\theta,\frac{2\pi}{N})-1\}^2},$$

in which N denotes the tooth number, n denotes the teeth order (n=1, 2, N), 2π/N denotes the tooth angle, $I_{\Delta\theta n}$ denotes a basic current value applied to the n-th tooth, e(•) denotes an exponential function for adjusting $I_{\Delta\theta n}$, and Bm is the variable value.

18. The apparatus of claim 17, wherein the $I_{\Delta\theta n}$ is calculated from an uneven pitch generating function $$I_{\Delta\theta n} = (-1)^n \cdot A_m\left\{\sin\left(P_1\frac{360}{N}n\right)\times\cos\left(P_2\frac{360}{N}n\right)\right\},$$

in which Am denotes a current reference value and has a range of 5A±20%, P1 and P2 are factors that affect a period of the basic current value, o<P1<N, and o<P2<N.

* * * * *